US008056944B2

(12) United States Patent
Jankowski et al.

(10) Patent No.: US 8,056,944 B2
(45) Date of Patent: Nov. 15, 2011

(54) LATCH ASSEMBLY FOR A VEHICLE DOOR

(75) Inventors: Krystof P. Jankowski, Waterford, MI (US); Igor Pereverzev, Farmington Hills, MI (US); Robert E. Tait, Redford, MI (US); Raymond E. Zeller, Westland, MI (US); Venkatesh Krishnan, Westland, MI (US); David Vern Cieglo, Bloomfield Hills, MI (US); James Joseph Loschiavo, Livonia, MI (US); Carsten C. Buettner, Cologne (DE)

(73) Assignee: Ford Global Technologies, Dearborn, MI (US)

( * ) Notice: Subject to any disclaimer, the term of this patent is extended or adjusted under 35 U.S.C. 154(b) by 1321 days.

(21) Appl. No.: 10/250,176

(22) Filed: Jun. 10, 2003

(65) Prior Publication Data

US 2003/0234544 A1 Dec. 25, 2003

Related U.S. Application Data

(60) Provisional application No. 60/388,279, filed on Jun. 13, 2002.

(51) Int. Cl.
*E05C 3/06* (2006.01)

(52) U.S. Cl. ..... 292/216; 292/201; 292/210

(58) Field of Classification Search ..... 292/201, 292/210, 216, DIG. 22, DIG. 65
See application file for complete search history.

(56) References Cited

U.S. PATENT DOCUMENTS 2,864,641 A * 12/1958 Leslie ..... 292/336.3
3,104,124 A * 9/1963 Beck ..... 292/280
3,453,015 A * 7/1969 Miller ..... 292/186
3,583,741 A 6/1971 Grabner et al.
3,719,248 A * 3/1973 Breitschwerdt et al. ..... 292/DIG. 22
3,799,596 A * 3/1974 Nozomu et al. ..... 292/216
3,990,531 A * 11/1976 Register ..... 292/DIG. 22
4,382,622 A * 5/1983 Ishikawa ..... 292/216
4,422,522 A * 12/1983 Slavin et al. ..... 292/DIG. 22
4,536,021 A * 8/1985 Mochida ..... 292/DIG. 22
5,431,462 A * 7/1995 Lignell ..... 292/216
5,577,782 A * 11/1996 Johnson et al. ..... 292/216
5,584,516 A * 12/1996 Cetnar ..... 292/336.3
5,769,471 A * 6/1998 Suzuki et al. ..... 292/216

(Continued)

FOREIGN PATENT DOCUMENTS

DE 1678024 8/1967

(Continued)

*Primary Examiner* — Peter M Cuomo
*Assistant Examiner* — Christopher Boswell
(74) *Attorney, Agent, or Firm* — Jerome R. Drouruard; Greg Brown

(57) ABSTRACT

An improved latch assembly (14) is provided for securing a vehicle door (12) in a closed position. Specifically, in one embodiment, the improved latch assembly (14) is intended to secure a first door fastener (16) to an opposing second door fastener (18) when the vehicle door (12) is subjected to a substantial acceleration. In this embodiment, the improved latch assembly (14) includes a release lever (26) coupled to the first door fastener (16). This release lever (26) is intended to selectively disengage the first door fastener (16) from the opposing second door fastener (18) thereby releasing the vehicle door (12) from its closed position. The Improved latch assembly (14) further includes an inertia-actuated detent lever (38) that is intended to block a predetermined path of the release lever (26) and prevent the release lever (26) from unlatching the vehicle door (12) from its closed position.

17 Claims, 9 Drawing Sheets

U.S. PATENT DOCUMENTS

| | | | | |
|---|---|---|---|---|
| 5,865,481 | A * | 2/1999 | Buschmann | 292/216 |
| 5,975,596 | A * | 11/1999 | Rogers et al. | 292/216 |
| 5,984,384 | A * | 11/1999 | Hamaguchi et al. | 292/216 |
| 6,010,164 | A * | 1/2000 | Yoda | 292/216 |
| 6,106,033 | A * | 8/2000 | Ruckert | 292/216 |
| 6,280,592 | B1 * | 8/2001 | Mastrofrancesco et al. | 292/DIG. 57 |
| 6,497,436 | B1 * | 12/2002 | DeBlock et al. | 292/216 |
| 6,520,550 | B2 * | 2/2003 | Kunst et al. | 292/216 |
| 6,575,508 | B2 * | 6/2003 | Stuart et al. | 292/336.3 |
| 6,709,033 | B2 * | 3/2004 | Jooss et al. | 292/336.3 |
| 2006/0131892 | A1 * | 6/2006 | Pereverzev | 292/216 |

FOREIGN PATENT DOCUMENTS

| | | | |
|---|---|---|---|
| DE | 195 11 651 | A1 | 10/1995 |
| DE | 29622837 | U1 | 7/1997 |
| DE | 197 38 492 | A1 | 3/1998 |
| GB | 2275727 | A | 9/1994 |

* cited by examiner

LATCH ASSEMBLY FOR A VEHICLE DOOR

CROSS REFERENCE TO RELATED APPLICATIONS

The present invention claims priority from U.S. Provisional Application Ser. No. 60/388,279 filed on Jun. 13, 2002, and entitled "Lateral Inertia Latch".

BACKGROUND OF INVENTION

The present invention relates generally to vehicle doors, and more particularly to an emergency-locking latch assembly that secures a vehicle door in a closed position when the vehicle door is subjected to a substantial acceleration.

Vehicle doors are commonly equipped with latch assemblies for securing the vehicle doors in a closed position. These latch assemblies can also be utilized for selectively releasing the vehicle doors from the closed position and allowing those doors to be swung open.

A typical latch assembly includes one or more ratchets for engaging corresponding striking pins that extend from a door jam of the vehicle. Each ratchet usually is coupled to a series of intermediate release levers for causing the ratchet to disengage from the striking pin. These intermediate release levers ordinarily are coupled to and operated by one or more actuation mechanisms, e.g. inside and outside door handles. A drawback of these latch assemblies is that they can become inoperable in a collision.

It would therefore be desirable to provide an improved latch assembly that secures a vehicle door in a closed position when the vehicle is subjected to a vehicle collision or various other conditions that impart a substantial acceleration upon the vehicle door.

SUMMARY OF INVENTION

The present invention provides an improved latch assembly that can be utilized for securing the ratchet to the striking pin. Specifically, in one embodiment, the improved latch assembly is intended to secure a first door fastener to an opposing second door fastener when the vehicle door is subjected to a substantial acceleration. In this embodiment, the improved latch assembly includes a release lever coupled to the first door fastener. This release lever is intended to selectively disengage the first door fastener from the opposing second door fastener thereby releasing the vehicle door from its closed position. The improved latch assembly, further includes an inertia-actuated detent lever that is pivotally coupled to a spindle mounted on the vehicle door. This inertia-actuated detent lever is moveable between a first unlocked position, a second unlocked position, and a third locked position. In the first unlocked position and the second unlocked position, the inertia-actuated detent lever is positioned for allowing the release lever to move along a predetermined path and unlatch the ratchet from the striking pin. On the other hand, in the third locked position, the inertia-actuated detent lever is aligned with the release lever in order to block the predetermined path of the release lever and prevent the release lever from unlatching the ratchet from the striking pin.

One advantage of the present invention is that an inertia actuated detent lever is provided that is regularly displaced upon actuation of the vehicle door handle in order to prevent the detent lever from inadvertently becoming fixed in one position or otherwise becoming inoperable.

Another advantage of the present invention is that an improved latch assembly is provided that can secure a vehicle door in a closed position.

Other advantages of the present invention will become apparent upon considering the following detailed description and appended claims, and upon reference to the accompanying drawings.

BRIEF DESCRIPTION OF DRAWINGS

For a more complete understanding of this invention, reference should now be made to the embodiments illustrated in greater detail in the accompanying drawings and described below by way of the examples of the invention.

DETAILED DESCRIPTION

Figure 1:
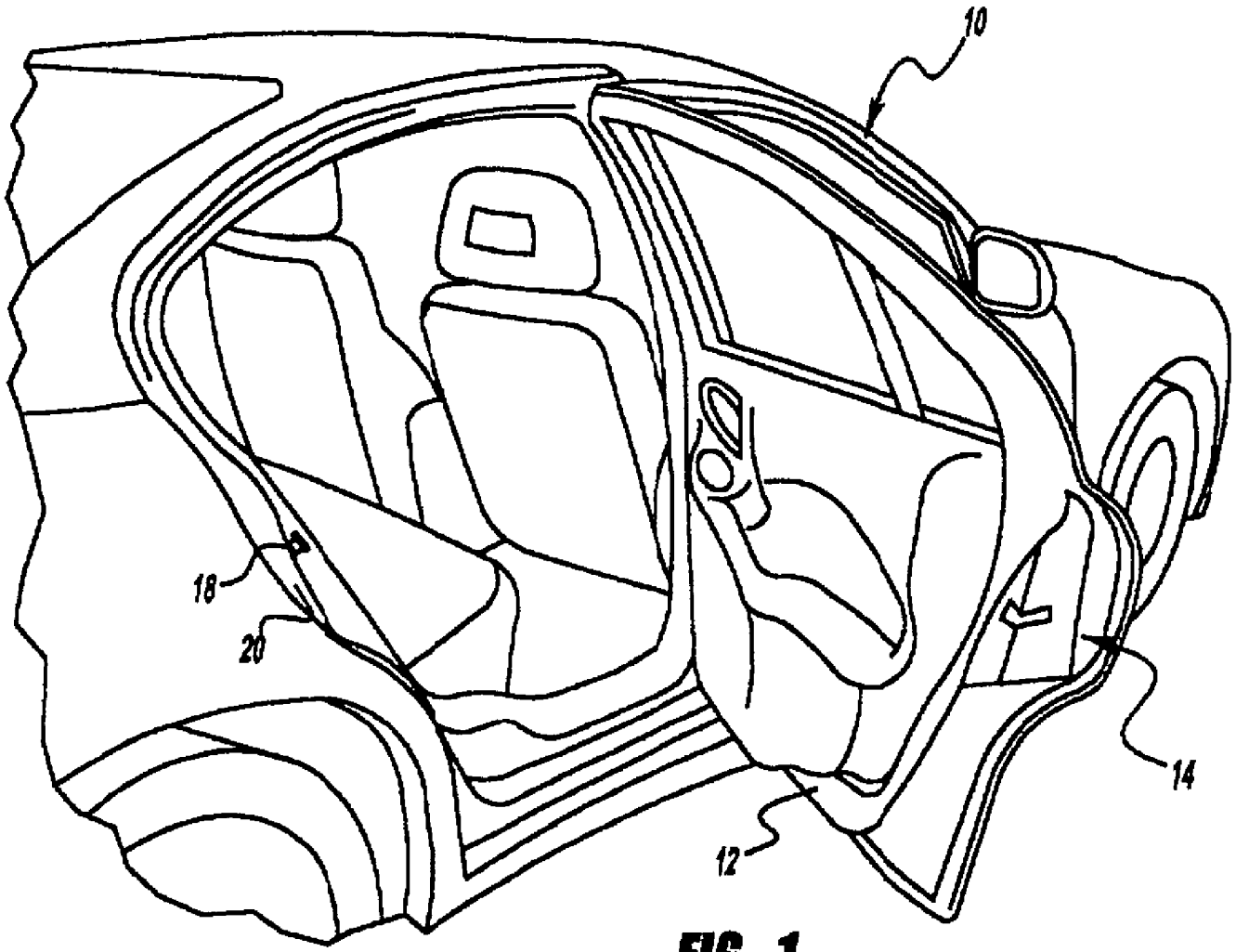
FIG. 1 is a perspective view of a vehicle with a vehicle door in an open position and having an improved latch assembly integrated therein, according to one embodiment of the present invention.

In the following figures, the same reference numerals are used to identify the same components in the various views.

The present invention is particularly suited for integration within a vehicle door for the purpose of securing the vehicle door in a closed position when the vehicle door is subjected to a vehicle collision or otherwise subjected to a substantial acceleration. In this regard, the embodiments described herein employ features where the context permits. However, it is understood that a variety of other embodiments without the described features are contemplated as well. For this reason, it follows that the present invention can be carried out in various other modes and utilized for other suitable applications as desired.

Referring to FIG. 1, there generally is shown a vehicle 10 having a vehicle door 12 with an improved latch assembly 14 (hereinafter referred to as "latch assembly") integrated therein, in accordance with one embodiment of the present invention. This latch assembly 14 is intended to secure a vehicle door 12 in its dosed position when the vehicle door 12 is subjected to a vehicle collision or otherwise subjected to a lateral inertia pulse, e.g. one greater than 20 Gs. Obviously, other magnitudes of forces may be the measuring point. The latch assembly 14 includes a ratchet 16 for engaging a striking pin 18 that extends from a door jam 20 of the vehicle 10. However, it should be noted that the latch assembly 14 can be integrated within the door jam 20 of the vehicle 10 instead of the vehicle door 12. In addition, it is also contemplated that the latch assembly 14 can utilize a variety of other suitable door fasteners besides the ratchet and the striking pin.

Figure 2:
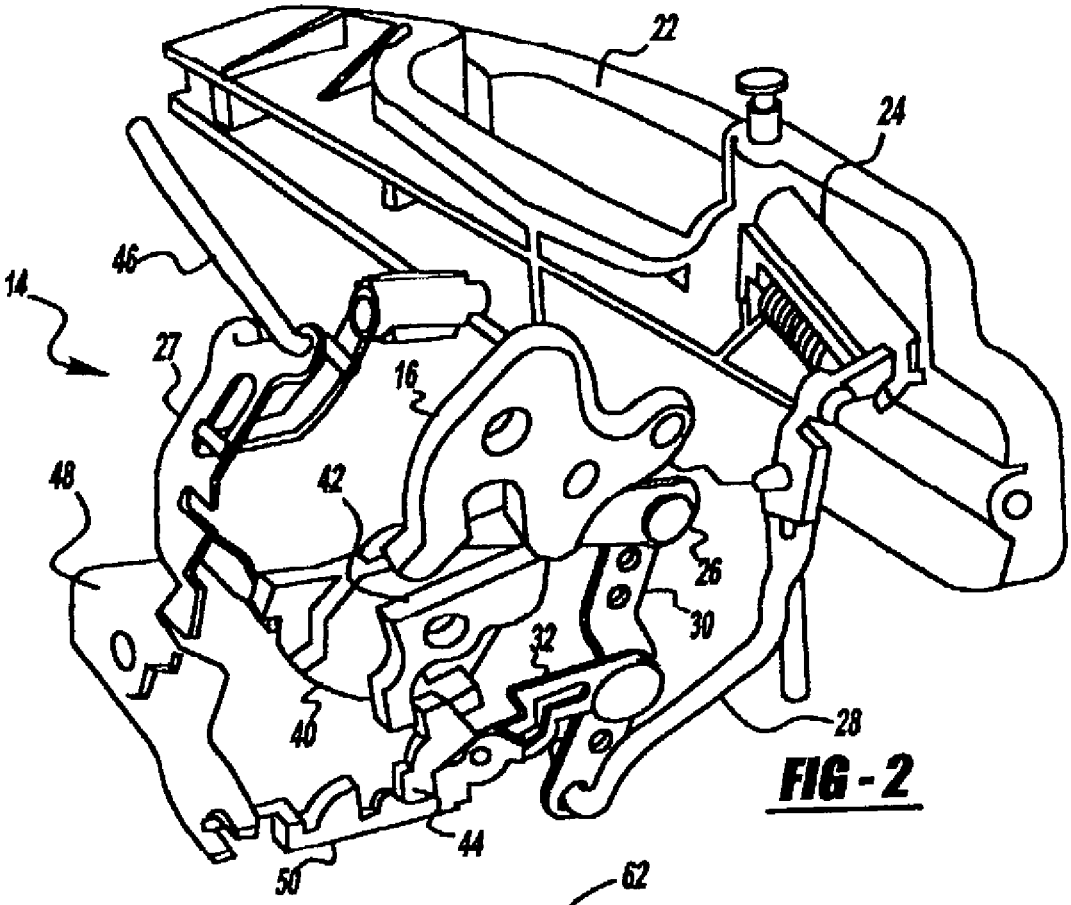
FIG. 2 is a rear perspective view of an improved latch assembly, according to one embodiment of the present invention.
Figure 3:
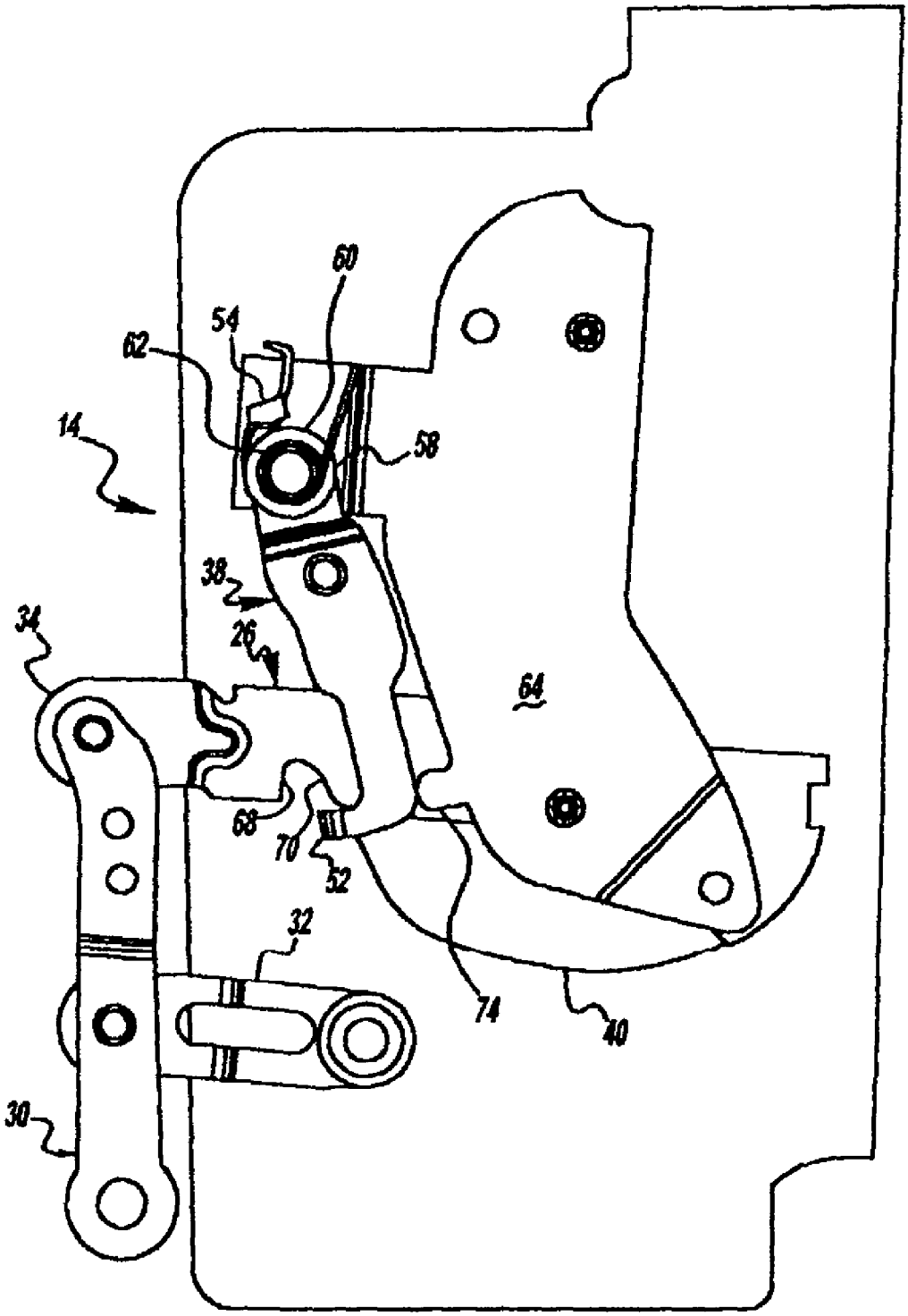
FIG. 3 is a front plan view of the improved latch assembly shown in FIG. 2.

Referring now to FIGS. 2 and 3, there are shown views of the latch assembly 14 according to one embodiment of the invention. The latch assembly 14 includes an actuation mechanism for operating the latch assembly 14 and causing the ratchet 16 to selectively disengage the striking pin 18. As shown in FIG. 2, this actuation mechanism is an outside door handle 22 that can be pulled or otherwise manipulated by an individual for the purpose of transferring an applied force and operating the latch assembly 14. Incidentally, it will be appreciated that the actuation mechanism can instead be various other suitable devices, e.g. an inside door handle or a remotely controlled motor.

The outside door handle 22 is coupled to a counterbalance mechanism 24 (shown in FIG. 2). This counterbalance mechanism 24 is intended to bias the outside door handle 22 to a predetermined position, e.g. a retracted position, and also to translate an applied force from the outside door handle 22 to other portions of the latch assembly 14. To accomplish these purposes, the counterbalance mechanism 24 has a torsion spring (not shown) or other suitable biasing member coupled thereto. The torsion spring can apply a biasing force that is sufficiently high for locating the outside door handle 22 in the retracted position when the outside door handle 22 is not being manipulated by an individual. In addition, the biasing force is also sufficiently low for permitting an individual to pull the outside door handle 22 from its retracted position and overcome the biasing force of the torsion spring so as to cause the counterbalance mechanism 24 to rotate.

In this embodiment, the counterbalance mechanism 24 is operatively coupled to an outside release lever 26 by way of three intermediate levers. Namely, these intermediate levers are a connecting rod 28, an extension lever 30, and an auxiliary locating lever 32. These intermediate levers generally are intended to translate the applied force from the counterbalance mechanism 24 to the release lever 26. However, it is understood that more or less than three intermediate levers can be utilized as desired. For example, the latch assembly may omit all intermediate levers and directly couple the actuation mechanism to the outside release lever.

Specifically, with particular attention to FIG. 2, the counterbalance mechanism 24 is coupled to the connecting rod 28 for the purpose of forcing the connecting rod 28 downward as the counterbalance mechanism 24 is rotated by the outside door handle 22. Similarly, the connecting rod 28 is coupled to the extension lever 30 and is intended to force the extension lever 30 downward. As best shown in FIG. 3, this extension lever 30 is attached to a moveable end of the auxiliary locating lever 32. This auxiliary locating lever 32 has an opposite end pivotally attached to a mounting surface on the latch assembly 14. In this regard, the auxiliary locating lever 32 is intended to restrict the movement of the extension lever 30 within a generally vertical direction. The extension lever 30 is further coupled to a tip portion 34 of the outside release lever 26 in order to transfer the applied force thereto.

Figure 4A:
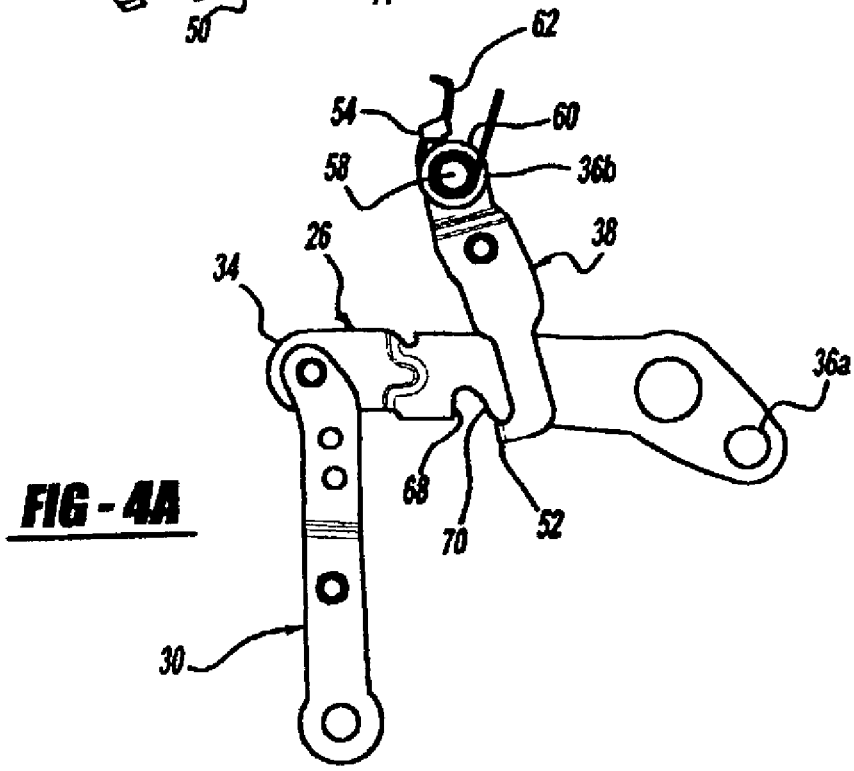
FIG. 4A is a plan view of a release lever and an inertia-actuated detent lever of the improved latch assembly, illustrating the release lever in a latched position and the inertia-actuated detent lever in a first unlocked position, according to one embodiment of the present invention.
Figure 4B:
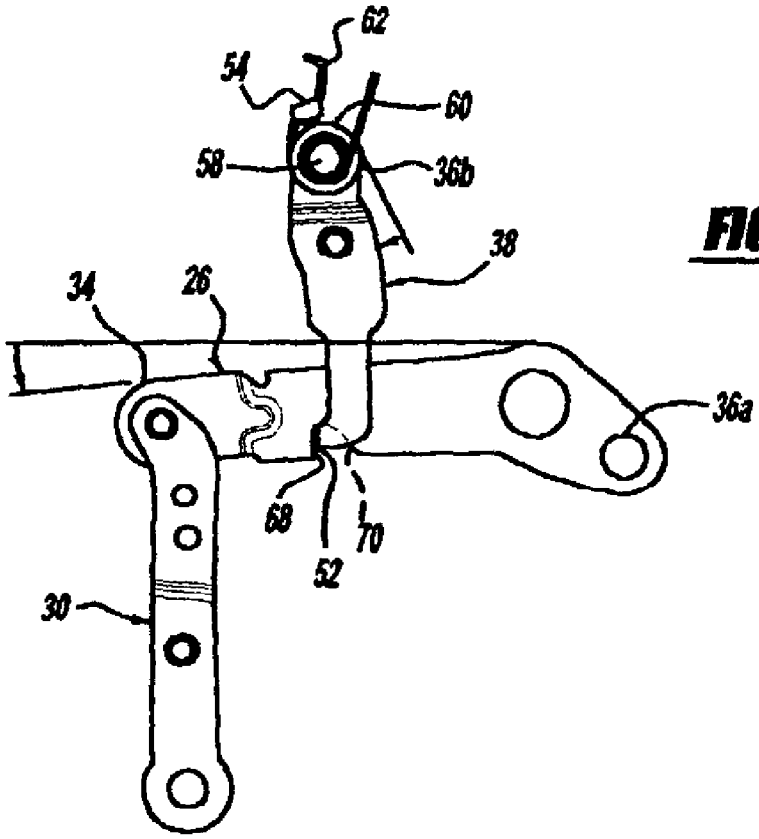
FIG. 4B is a plan view of a release lever and an inertia-actuated detent lever of the improved latch assembly, illustrating the release lever in an unlatched position and the inertia-actuated detent lever in a second unlocked position, according to one embodiment of the present invention.

The outside release lever 26 further includes a pivoting end portion 36*a* that is pivotally coupled to a mounting surface of the latch assembly 14. The outside release lever 26 can pivot between a latched position (as shown in FIG. 4A) and an unlatched position (as shown in FIG. 4B). Furthermore, this outside release lever 26 has an inertia-actuated detent lever 38 (hereinafter referred to as "detent lever") operatively coupled thereto for securing the outside release lever 26 in the latched position. This detent lever 38 is detailed in the description for FIGS. 4A-4C and 5.

In general, the movement of the outside release lever 26 between the latched position and the unlatched position allows the latch assembly 14 to disengage the ratchet 16 from the striking pin 18 and allows an individual to swing open the vehicle door 12.

The pivoting end portion 36*a* of the outside release lever 26 has a tab (not shown) extending laterally outward therefrom for contacting a triple hammer device 40 and causing the triple hammer device 40 to pivot about its rotation of axis. In this regard, pivoting the outside release lever 26 from the latched position to the unlatched position causes the triple hammer device 40 to likewise pivot. This triple hammer device 40 is operatively coupled to a pawl 42 via a locking link 44. The pawl 42 is intended to secure the ratchet 16 in a latched position. Rotating the triple hammer device 40 causes the pawl 42 to pivot and disengage from the ratchet 16. As a result, the ratchet 16 releases the striking pin 18 and allows the vehicle door 12 to be swung open.

From the foregoing, it will be seen that the latch assembly 14 can also include an inside door handle (not shown) coupled to an inside release lever 27 by way of a cable 46. This inside release lever 27 can be selectively coupled to the triple hammer device 40 to cause the triple hammer device 40 to disengage the pawl 42 from the ratchet 16 and release the striking pin 18 from the ratchet 16.

It is also contemplated that the latch assembly 14 can include an auxiliary inside lever 48 for disabling the latch assembly 14 and locking the vehicle door 12 in a latched position. As is known in the art, this auxiliary inside lever 48 is coupled to the locking link 44 by way of a lock element 50 or other suitable mechanism. In this respect, the auxiliary inside lever 48 can actuate the locking link 44 and detach the triple hammer device 40 from the pawl 42 thereby preventing the triple hammer device 40 from disengaging the pawl 42 from the ratchet 16. As a result, the operation of either door handle 22 would not cause the ratchet 16 to disengage the striking pin 18.

Referring now to FIGS. 4A and 4B, there are shown perspective views illustrating the outside release lever 26 in latched and unlatched positions, respectively, in accordance with one embodiment of the present invention. As hereinbefore set forth, the extension lever 30 can pull the tip portion 34 of the outside release lever 26 generally downward for the purpose of causing the outside release lever 26 to pivot about its pivoting end portion 36a and releasing the vehicle door 12 from its closed position.

Figure 4C:
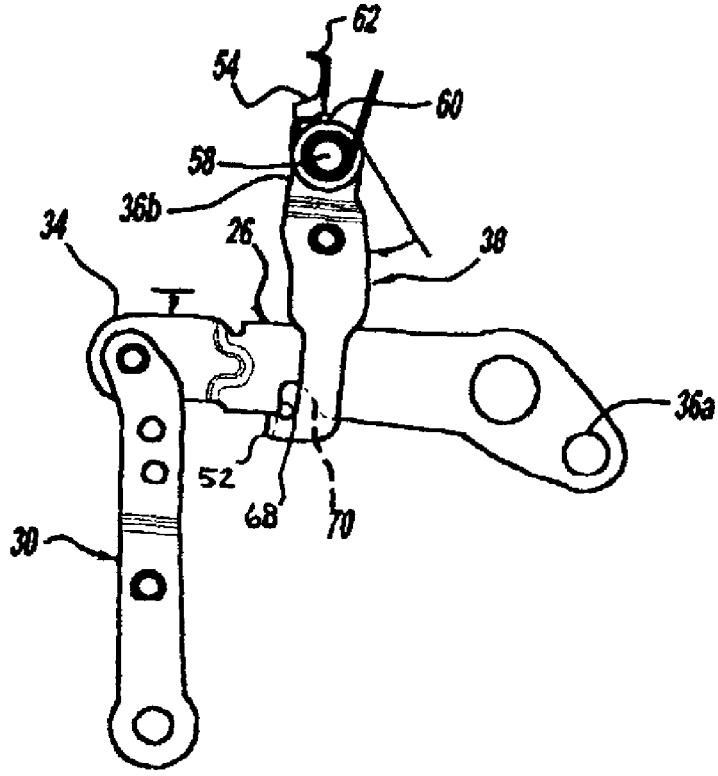
FIG. 4C is a plan view of a release lever and an inertia-actuated detent lever of the emergency-locking latch assembly, illustrating the release lever in a latched position and the inertia-actuated detent lever in a detent position, according to one embodiment of the present invention.
Figure 5:
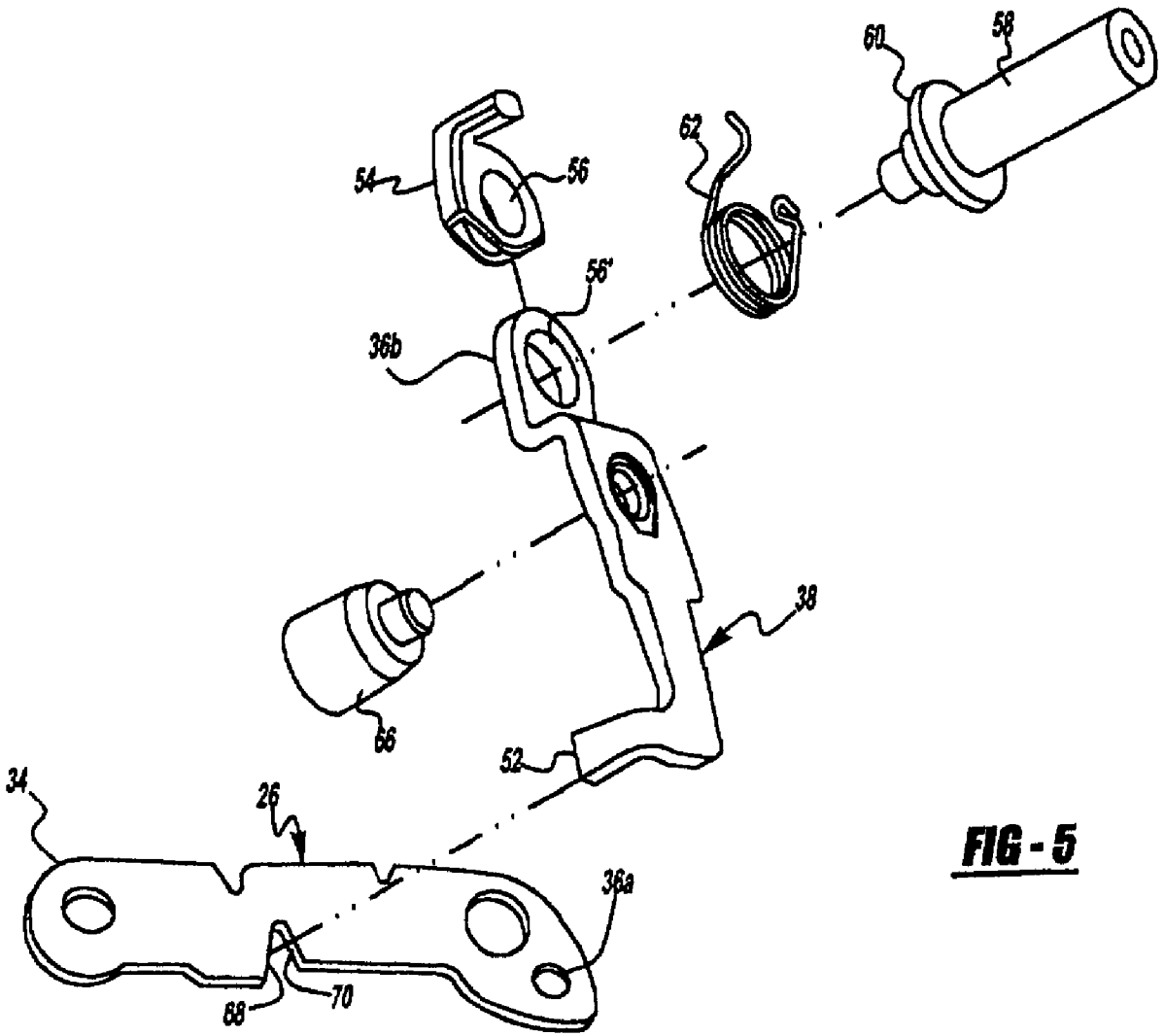
FIG. 5 is an exploded view of an inertia-actuated detent lever, according to one embodiment of the present invention.

This outside release lever 26 has the inertia-actuated detent lever 38 operatively coupled thereto for selectively locking the outside release lever 26 in the latched position. Specifically, this detent lever 38 has a detent tab 52 (as best shown in FIG. 5) extending therefrom for selectively engaging the outside release lever 26 and preventing the outside release lever 26 from pivoting along a predetermined path for unlatching the ratchet 16 from the striking pin 18. This detent lever 38 is moveable between a first unlocked position (as shown in FIG. 4B), a second unlocked position (as shown in FIG. 4B), and a third locked position (as shown in FIG. 4C). In the first unlocked position and the second unlocked position, the detent tab 52 is offset from the outside release lever 26 in order to allow the outside release lever 26 to unlatch the ratchet 16 from the striking pin 18. In the third locked position, the detent tab 52 blocks the path of the outside release lever 26 and locks the lever 26 in the latched position.

In one embodiment, as best shown in FIG. 5, the detent lever 38 has a pivoting end portion 36*b* that is sized for being covered by an encapsulation ring 54. The encapsulation ring 54 and the pivoting end portion 36*b* of the detent lever 38 each have an aperture 56, 56' integrally formed therethrough for receiving a spindle member 58 and pivotally coupling the detent lever 38 to a mounting surface of the latch assembly 14, e.g, the back plate 64. The spindle member 58 includes an annular flange 60 for retaining the detent lever 38 against the back plate 64. The encapsulation ring 54 is comprised of a plastic material or other suitable corrosive-resistant material. In this regard, the encapsulation ring 54 is intended to prevent the corrosion of the mating surfaces between the annular flange 60 of the spindle member 58 and the pivoting end portion 36*b* of the detent lever 38. One skilled in the art would understand that the corrosion between those mating surfaces can fix the detent lever 38 in one position on the spindle member 58 thereby preventing the detent lever 38 from pivoting between the first unlocked position, the second unlocked position, and the third locked position. For that reason, the encapsulation ring 54 is beneficial for facilitating the free pivoting movement of the detent lever 38 on the spindle member 58 and thus allowing for the operation of the detent lever 38.

Moreover, the detent lever 38 has a torsion spring 62 coupled thereto for moving the detent lever 38 to its first unlocked position. However, instead of the torsion spring 62, it is contemplated that a variety of other suitable biasing members or even gravity can be utilized as desired.

Referring back to the embodiment shown in FIG. 3, the back plate 64 includes a lever guide member, e.g. a detent finger 74, extending therefrom for contacting the detent lever 38 and preventing the torsion spring 62 from moving the detent lever 38 in a counter-clockwise direction beyond its first unlocked position. However, it is contemplated that the lever guide member can have various other suitable constructions as desired. In addition, it is also understood that the lever guide member can be omitted from the latch assembly 14 provided that the resting position of the biasing member locates the detent lever 38 in its first unlocked position.

Referring back to FIG. 5, the detent lever 38 further includes a counterweight member 66 fixedly coupled thereto for allowing a substantial lateral acceleration of the detent lever 38, e.g. one caused by a side impact, to pivot the detent lever 38 from the first unlocked position to the third locked position. In this regard, the acceleration of the detent lever 38 and its counterweight member 66 produces a resultant inertia force that is greater than the biasing force of the torsion spring 62. For that reason, the resultant inertia force moves the detent lever 38 to the third locked position and prevents the outside release lever 26 from disengaging the ratchet 16 from the striking pin 18.

It is understood that the stiffness of the torsion spring 62, the mass of the counterweight member 66, and the location of the counterweight member 66 on the detent lever 38 can be adjusted according to the desired reaction characteristics of the detent lever 38. For example, a side impact under the action of a lateral inertia pulse above the 20 G level can cause the vehicle door to unlatch during the first 10 milliseconds after impact. Accordingly, the detent lever 38 can be tuned to engage the outside release lever 26 when the detent lever 38 is subjected to those particular conditions.

Additionally, it is understood that tuning the detent lever 38 and the outside release lever 26 can determine the amount of the angular and linear displacements of those lever 38, 26 required for engaging the detent lever 38 to the outside release lever 26. For instance, the detent lever 38 can be tuned such that the engagement between the detent lever 38 and the outside release lever 26 occurs under two conditions. The first condition can be that the detent lever 38 rotates by about 6.7 degrees thereby displacing the detent tab 52 by approximately 3.6 millimeters. Moreover, the second condition can be that the outside release lever 26 rotates about 3.6 degrees so as to displace the tip portion 34 of the outside release lever 26 by less than about 3.8 millimeters. However, it will be appreciated that various other angular and linear displacements of the outside release lever 26 and the detent lever 38 can be utilized for locking the latch assembly 14 in a latched position.

In the particular embodiment illustrated in FIGS. 4A-4C, the outside release lever 26 has a notch 68 integrally formed therein for receiving the detent tab 52 when the detent lever 38 is in the first unlocked position. In this regard, the notch 68 allows the outside release lever 26 to pivot about its pivoting end portion 36*a* thereby allowing the vehicle door 12 to be unlatched when the detent lever 38 is moved to the second unlocked position.

The outside release lever 26 further includes a sloped contact surface 70 disposed within the notch 68 for maintaining the free movement of the detent lever 38. Specifically, the sloped contact surface 70 is intended to contact the detent tab 52 and pivot the detent lever 38 from the first unlocked position and the second unlocked position when the outside release lever 26 is moved from its latched position to its unlatched position. This movement of the detent lever 38 can break dust sediment or corrosion build-up that can accumulate between the mating surfaces of the detent lever 38 and the spindle member 58. In this regard, the sloped contact surface 70 can prevent the detent lever 38 from becoming fixed in one position.

Figure 6:
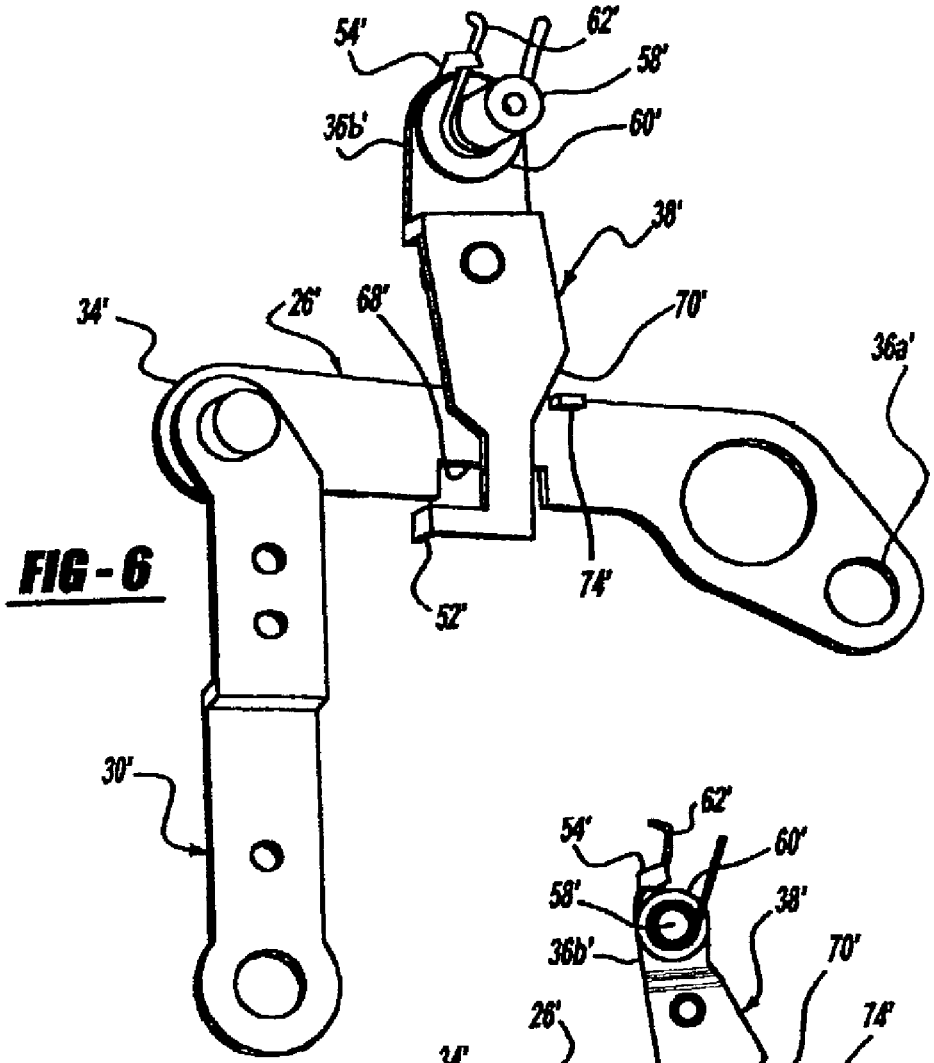
FIG. 6 is a perspective view of a release lever and an inertia-actuated detent lever of the improved latch assembly, according to another embodiment of the present invention.
Figure 7A:
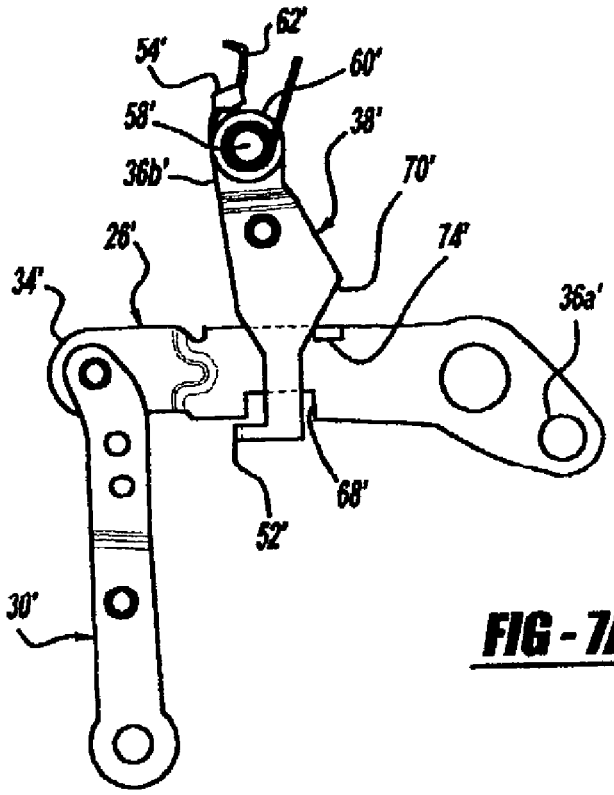
FIG. 7A is a plan view of a release lever and an inertia-actuated detent lever of the improved latch assembly, illustrating the release lever in a latched position and the inertia-actuated detent lever in a first unlocked position, according to another embodiment of the present invention.
Figure 7B:
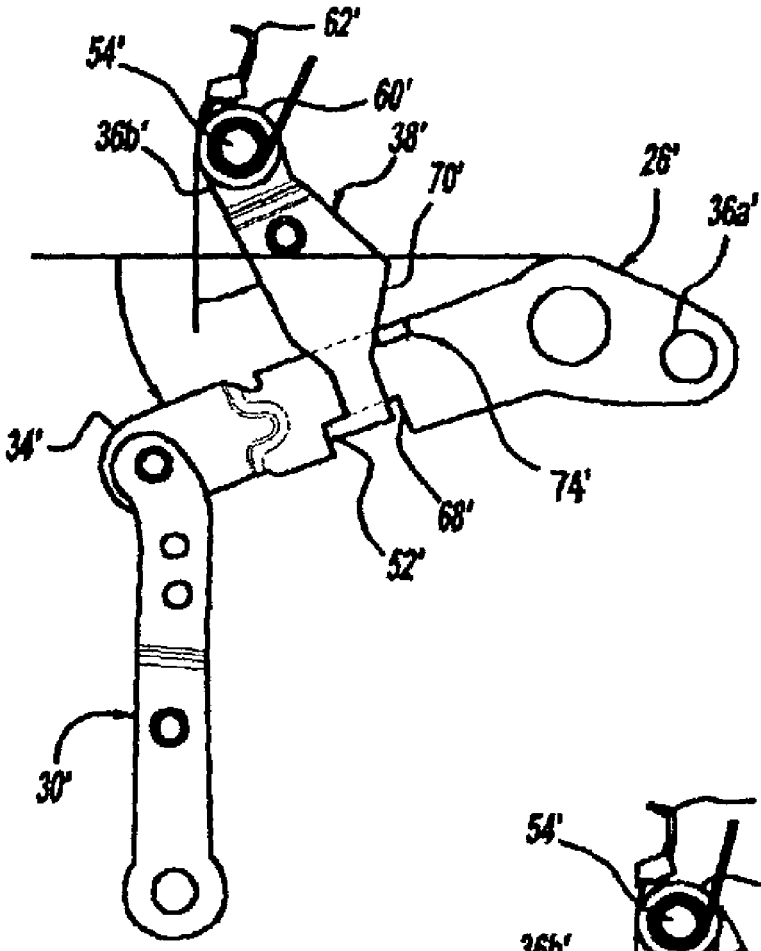
FIG. 7B is a plan view of a release lever and an inertia-actuated detent lever of the improved latch assembly, illustrating the release lever in an unlatched position and the inertia-actuated detent lever in a second unlocked position, according to another embodiment of the present invention.

Referring now to FIG. 6, there is shown a perspective view of an outside release lever 26' and a detent lever 38' of a latch assembly 14', according to another embodiment of the present invention. In greater detail, FIG. 7A shows this release lever 26' in a latched position with the detent lever 38' in the first unlocked position. Furthermore, FIG. 7B illustrates the outside release lever 26' moved to an unlatched position thereby simultaneously causing the decent lever 38' to move to the second unlocked position. This relationship in movement between the outside release lever 26' and the detent lever 38' is detailed in the description for the lever guide member.

In the embodiment shown in these figures, the latch assembly 14' includes a torsion spring 62' coupled between the detent lever 38' and a back plate 64'. This torsion spring 62' is intended to move the detent lever 38' in a predetermined direction. For example, as depicted in the FIGS. 7A and 7B, the torsion spring 62' is employed for moving the detent lever 38' in counter-clockwise direction from its first unlocked position to its second unlocked position. It will be appreciated that various suitable biasing members other than the torsion spring can be utilized to move the detent lever in various suitable directions. Moreover, it is also contemplated that other suitable mounting surfaces in the latch assembly 14' can be employed in place of the back plate 64'.

The latch assembly 14' further includes a lever guide member, e.g. a detent protrusion 74', extending from the outside release lever 26' for contacting the detent lever 38' and preventing the torsion spring 62' from moving the detent lever 38' beyond a predetermined position. Specifically, this detent protrusion 74' extends laterally outward from the outside release lever 26'(as best shown in. FIG. 6) and is intended to contact a sloped contact surface 70' of the detent lever 38'. For example, with reference to FIG. 7A, when the outside release lever 26' remains in the latched position, the detent protrusion 74' and the torsion spring 62 collectively position the detent lever 38' in its first unlocked position. However, turning now to FIG. 7B, as the outside release lever 26' pivots from its latched position to its unlatched position, the detent protrusion 74' slides across the sloped contact surface 70' thereby allowing the torsion spring 62' to move the detent lever 38' to its second unlocked position.

In other words, the detent lever 38' is routinely pivoted about the spindle member 58' each time the outside release lever 26' is moved between its latched position and its unlatched position. As mentioned above, this feature is beneficial because it can break up the accumulation of dust sediment or the corrosion of mating surfaces that can otherwise fix the detent lever 38' in one position on the spindle member 58'. In that regard, the detent lever 38' can freely move between the first unlocked position. the second unlocked position, and the third locked position. As a result, the detent lever 38' is freely movable for locking the latch assembly 14' in a latched position when it is subjected to a substantial lateral acceleration while allowing for normal operation of the latch assembly 14'.

Figure 7C:
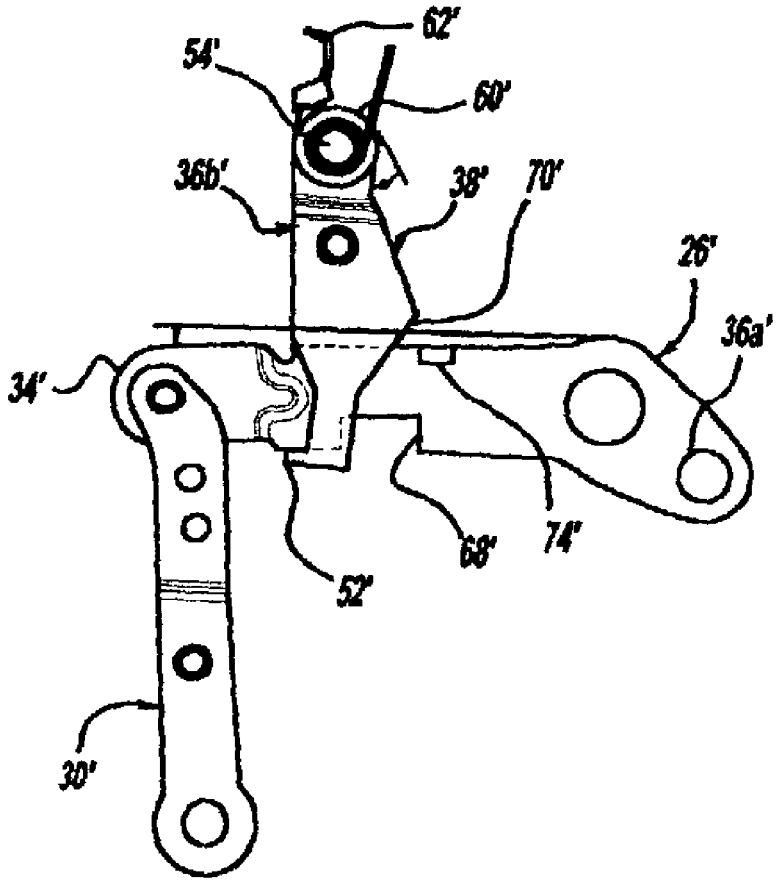
FIG. 7C is a plan view of a release lever and an inertia-actuated detent lever of the emergency-locking latch assembly, illustrating the release lever in a latched position and the inertia-actuated detent lever in a detent position, according to another embodiment of the present invention.

In the particular embodiment illustrated in FIGS. 7A-7C, the detent lever 38' has a detent tab 52' extending therefrom for selectively engaging the outside release lever 26' and preventing the outside release lever 26' from moving from the latched position to the unlatched position. Upon inspection of FIG. 7C, it will be seen that a lateral inertia pulse, e.g. one greater than about 20 Gs, can cause the detent lever 38' to remain in its detent position as the outside release lever 26' begins moving toward its unlatched position thereby removing the detent protrusion 74' from the sloped contact surface 70'. In this regard, the lateral inertia pulse can take the place of the detent protrusion 74' by opposing the force of the torsion spring 62' and holding the detent lever 38' in the detent position. In this position, the detent tab 52' will contact the outside release lever 26' and lock the latch assembly 14' in a latched position.

As exemplified in FIG. 7B, the outside release lever 26' has a notch 68' integrally formed therein for receiving the detent tab 52' and allowing the outside release lever 26' to move to its unlatched position. Specifically, when the detent lever 38' is moved to its first unlocked position, the detent tab 52' is aligned with the notch 68' and therefore allows the notch 68' to receive the detent tab 52' . For that reason, the notch 68' can allow the outside release lever 26' to move to its unlatched position. However, it will be appreciated that the notch can be otherwise structured or even entirely omitted from the outside release lever. For example, in another embodiment, the notch can be entirely omitted where the detent tab does not contact the outside release lever when the detent tab is in the first unlocked position and the second unlocked position.

Figure 8:
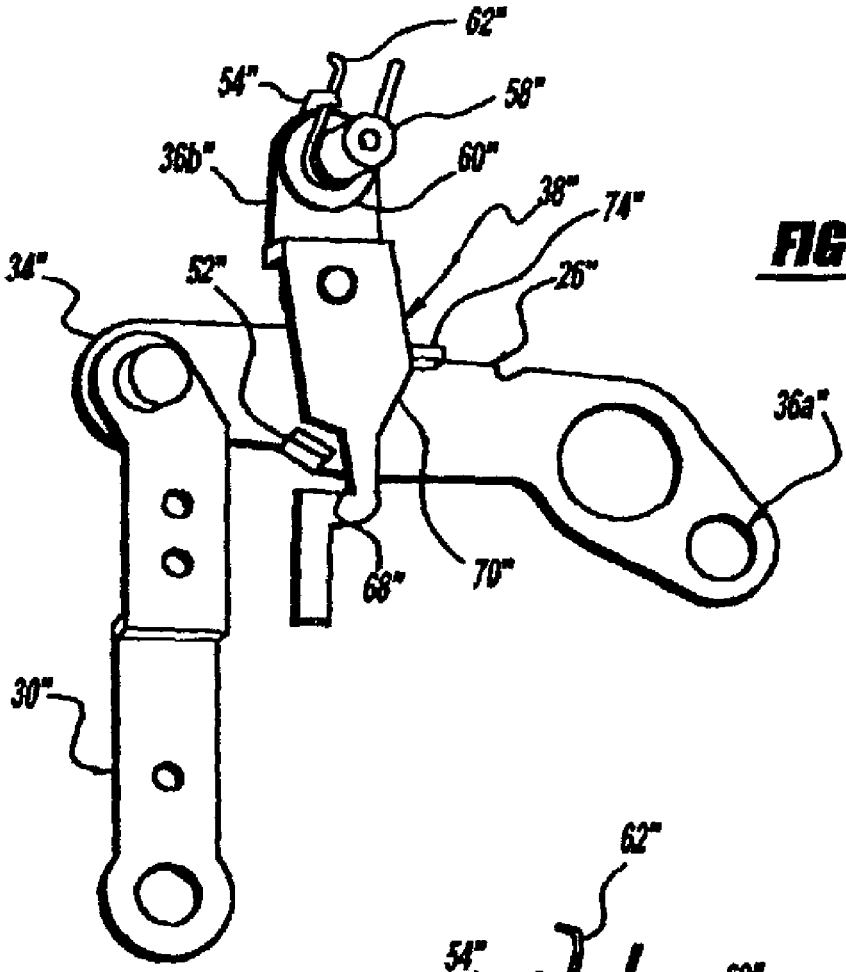
FIG. 8 is a perspective view of a release lever and an inertia-actuated detent lever of the emergency-locking latch assembly, according to yet another embodiment of the present invention.
Figure 9A:
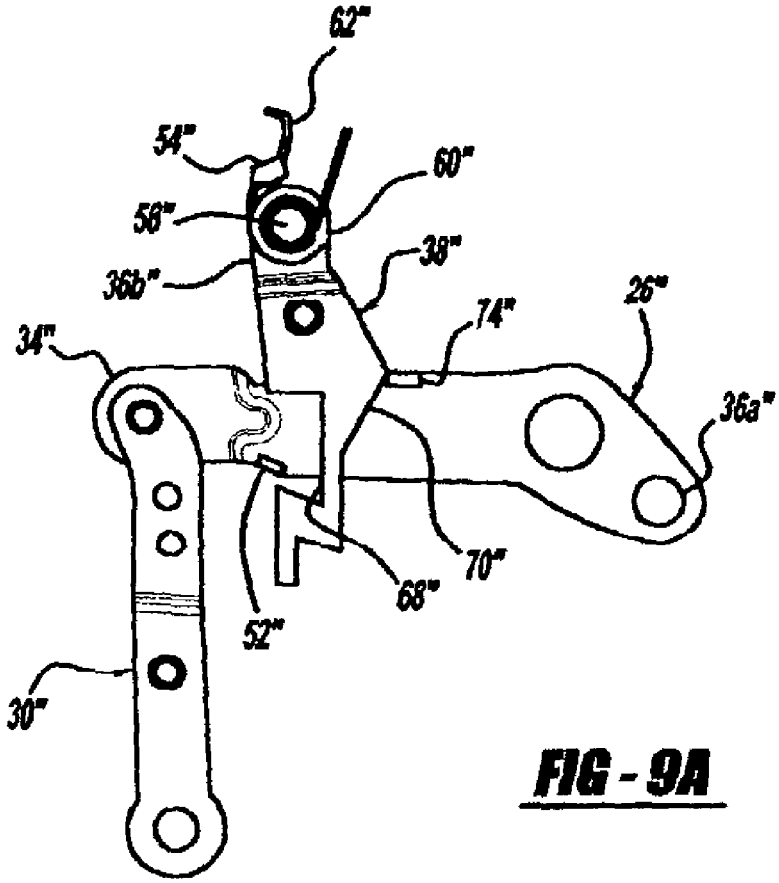
FIG. 9A is a plan view of a release lever and an inertia-actuated detent lever of the improved latch assembly, illustrating the release lever in a latched position and the inertia-actuated detent lever in a first unlocked position.
Figure 9B:
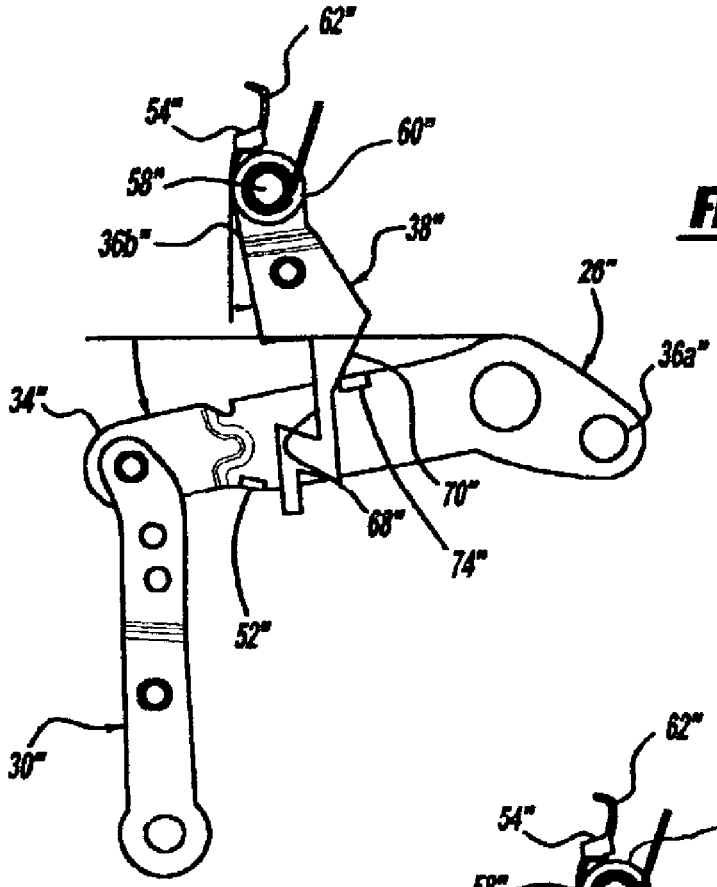
FIG. 9B is a plan view of a release lever and an inertia-actuated detent lever of the improved latch assembly, illustrating the release lever in an unlatched position and the inertia-actuated detent lever in a second unlocked position.

Referring now to FIG. 8, there is shown a perspective view of an outside release lever 26"and a detent lever 38"of a latch assembly 14", according to yet another embodiment of the present invention. FIG. 9A illustrates this release lever 26" in a latched position and the detent lever 38" in the first unlocked position. In addition, FIG. 9B illustrates the outside release lever 26" moved to an unlatched position thereby simultaneously causing the detent lever 38" to move to the second unlocked position. The overall construction for the outside release lever 26" and the decent lever 38" is detailed in the description for the lever guide member.

This embodiment requires that the latch assembly 14" includes a torsion spring 62" coupled between the detent lever 38" and a back plate 64", This torsion spring 62" is intended to move the detent lever 38" in a predetermined direction. By way of example, as shown in the FIGS. 9A and 9B, the torsion spring 62" is utilized for moving the detent lever 38" in a counter-clockwise direction from its first unlocked position to its second unlocked position. It is understood that various other suitable biasing members besides the torsion spring can be utilized to move the detent lever in various suitable directions. Moreover, it will also be appreciated that other suitable mounting surfaces in the latch assembly 14" can be utilized instead of the back plate 64".

Figure 9C:
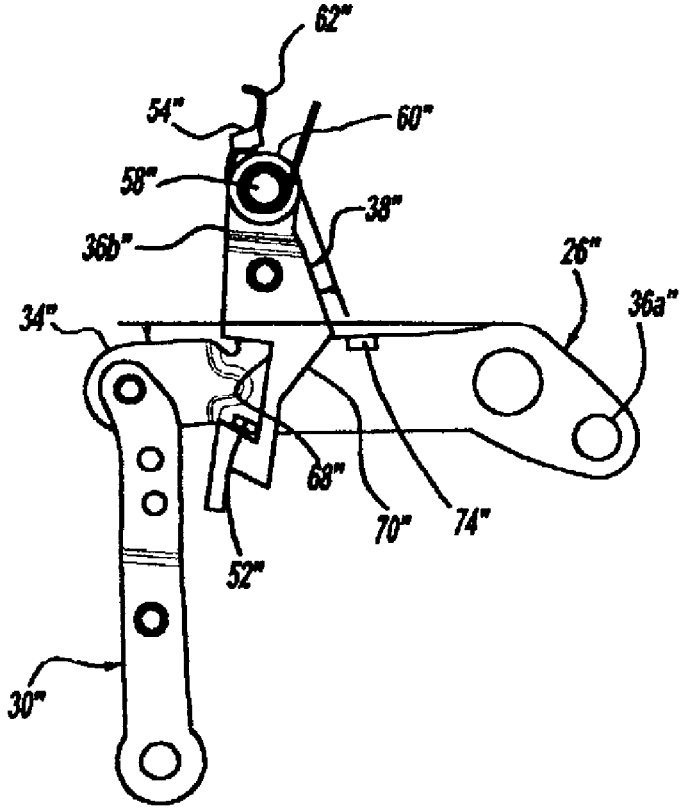
FIG. 9C is a plan view of a release lever and an inertia-actuated detent lever of the emergency-locking latch assembly, illustrating the release lever in a latched position and the inertia-actuated detent lever in a detent position.

The latch assembly 14" further includes a lever guide member, e.g. a detent protrusion, 74", extending from the outside release lever 26" (as best illustrated in FIG. 8) for contacting the detent lever 38" and preventing the torsion spring 62" from moving the detent lever 38" beyond a predetermined position. In particular, this detent protrusion 74" extends laterally outward from the outside release lever 26" and is intended to contact a sloped contact surface 70" of the detent lever 38". For instance, it will be apparent from FIG. 9A that when the outside release lever 26" remains in the latched position, the detent protrusion 74" and the torsion spring 62" collectively position the detent lever 38" in its first unlocked position. Furthermore, turning to FIG. 9B, as the outside release lever 26" pivots from its latched position to its unlatched position, the detent protrusion 74" slides across the sloped contact surface 70" thereby allowing the torsion spring 62" to move the detent lever 38" to its second unlocked position. This feature allows the detent lever 38" to regularly pivot about the spindle member 58' each time the outside release lever 26' is moved between its latched position and its unlatched position. As hereinbefore stated, the advantage of this feature is that it can break up the accumulation of dust sediment or the corrosion of mating surfaces that can otherwise fix the detent lever 38' in one position on the spindle member 58'. For that reason, the detent lever 38' can freely move between the first unlocked position, the second unlocked position, and the third locked position. As a result, the detent lever 38' is freely movable for locking the latch assembly 14' in a latched position when it is subjected to a substantial lateral acceleration while allowing for normal operation of the latch assembly 14', In this embodiment, the outside release lever 26" has a detent tab 52" extending therefrom for selectively engaging the detent lever 38" and preventing the outside release lever 26" from moving from the latched position to the unlatched position. In particular, as shown in FIG. 9C, a lateral inertia pulse, e.g. one greater than about 20 Gs, can cause the detent lever 38" to remain in its detent position as the outside release lever 26" begins moving toward its unlatched position. It is understood that as the outside release lever 26" pivots toward its unlatched position, the detent protrusion 74" is removed from the sloped contact surface 70". In this regard, the lateral inertia pulse takes the place of the detent protrusion 74" by opposing the force of the torsion spring 62" and holding the detent lever 38" in the detent position. In this position, the detent tab 52" contacts the detent lever 38" and locks the latch assembly 14" in a latched position.

Furthermore, according to this embodiment, the detent lever 341 has a notch 68" integrally formed therein for receiving the detent tab 52" and preventing the outside release lever 26" to move to its unlatched position. Specifically, when the detent lever 38" is moved to its detent position, the detent tab 52" is aligned with the notch 68". As a result, the notch 68" can receive the detent tab 52" therein and cause the detent lever 38" to engage the detent tab 52". In this way, the notch 68" can prevent the outside release lever 26" from moving to its unlatched position.

However, it will be appreciated that the notch can be otherwise structured or even entirely omitted from the outside release lever. For example, as described hereinabove, in another embodiment, the notch can be entirely omitted where the detent tab does not contact the outside release lever when the detent tab is in the first unlocked position and the second unlocked position.

While particular embodiments of the invention have been shown and described, it will be understood, of course, that the invention is not limited thereto since modifications may be made by those skilled in the art, particularly in light of the foregoing teachings. Accordingly, it is intended that the invention be limited only in terms of the appended claims.

The invention claimed is:

1. A detent mechanism for an improved latch assembly within a vehicle door for securing a first door fastener to a second door fastener under a predetermined condition, comprising:

a mounting member fixedly attached to said vehicle door and remaining in one fixed position; and an inertia-actuated detent lever pivotally attached directly to said mounting member;

said inertia-actuated detent lever moveable to a locked position for contacting a release mechanism upon occurrence of said predetermined condition and whereby said first door fastener and said second door fastener are secured together;

said inertia-actuated detent lever moveable between a first unlocked position and a second unlocked position upon actuation of a door handle so as to prevent said inertia-actuated detent lever from becoming fixed in one position.

2. The detent mechanism recited in claim 1 further comprising:

a biasing member coupled directly between said inertia-actuated detent lever and said mounting member;

said biasing member biasing said inertia-actuated detent lever to one of a first unlocked position and a second unlocked position.

3. The detent mechanism recited in claim 1 wherein said inertia-actuated detent lever is pivotally attached to said mounting member by a spindle member.

4. The detent mechanism recited in claim 1 wherein said inertia-actuated lever has a detent tab for directly contacting and blocking movement of said release mechanism upon occurrence of said predetermined condition and whereby said first door fastener and said second door fastener are secured together.

5. The detent mechanism recited in claim 1 further comprising:

a detent tab extending from said inertia-actuated detent lever;

said release mechanism having a sloped contact surface;

said sloped contact surface contacting said detent tab and moving said inertia-actuated detent lever between a first unlocked position and a second unlocked position.

6. An improved latch assembly for a vehicle door for securing a first door fastener to a second door fastener under a predetermined condition, comprising:

a release mechanism coupled to said first door fastener;

said release mechanism moveable along a predetermined path for selectively disengaging said first door fastener from said second door fastener;

a mounting member fixedly attached to said vehicle door and remaining in one fixed position; and an inertia-actuated detent lever pivotally attached directly to said mounting member;

said inertia-actuated detent lever moveable to a locked position for contacting and blocking movement of said release mechanism upon occurrence of said predetermined condition and whereby said first door fastener and said second door fastener are secured together;

said inertia-actuated detent lever moveable between a first unlocked position and a second unlocked position upon actuation of a door handle so as to prevent said inertia-actuated detent lever from becoming fixed in one position.

7. The improved latch assembly recited in claim 6 wherein said door handle is actuated for moving said release mechanism along said predetermined path.

8. The improved latch assembly recited in claim 6 further comprising:

a biasing member coupled directly between said inertia-actuated detent lever and said mounting member;

said biasing member biasing said inertia-actuated detent lever to one of said first unlocked position and said second unlocked position upon release of said door handle;

said release mechanism biasing said inertia-actuated detent lever to the other of said first unlocked position and said second unlocked position upon actuation of said door handle.

9. The improved latch assembly recited in claim 6 wherein said inertia-actuated detent lever is pivotally attached to said mounting member by a spindle member.

10. The improved latch assembly recited in claim 9 wherein said inertia-actuated detent lever has a pivoting end with an encapsulation ring attached thereto for sufficiently separating said inertia-actuated detent lever from said spindle member and preventing corrosion therebetween.

11. An improved latch assembly for a vehicle door for securing a first door fastener to a second door fastener under a predetermined condition, comprising:

a release mechanism coupled to said first door fastener;

said release mechanism moveable along a predetermined path for selectively disengaging said first door fastener from said second door fastener;

a mounting member fixedly attached to said vehicle door and remaining in one fixed position;

an inertia-actuated detent lever pivotally attached directly to said mounting member; and a detent tab extending perpendicularly from one of said inertia-actuated detent lever and said release mechanism;

said detent tab contacting the other of said inertia-actuated detent lever and said release mechanism when said inertia-actuated detent lever is moved to a locked position upon occurrence of said predetermined condition and whereby said first door fastener and said second door fastener are secured together;

said inertia-actuated detent lever moveable between a first unlocked position and a second unlocked position upon actuation of a door handle so as to prevent said inertia-actuated detent lever from becoming fixed in one position.

12. The improved latch assembly recited in claim 11 further comprising:

a biasing member coupled directly between said inertia-actuated detent lever and said mounting member;

said biasing member biasing said inertia-actuated detent lever to one of said first unlocked position and said second unlocked position.

13. The improved latch assembly recited in claim 11 wherein said release mechanism has a notch integrally formed therein for receiving said detent tab when said inertia-actuated detent lever is located in at least one of said first unlocked position and said second unlocked position.

14. The improved latch assembly recited in claim 11 wherein said inertia-actuated detent lever has a counterweight fixedly coupled thereto for moving said inertia-actuated detent lever to said locked position.

15. The improved latch assembly recited in claim 11 further comprising:

a sloped contact surface on said inertia-actuated detent lever; and a lever guide member extending from said release mechanism;

said lever guide member contacting said sloped contact surface and moving said inertia-actuated detent lever between said first unlocked position and said second unlocked position.

16. The improved latch assembly recited in claim 11 further comprising:

a sloped contact surface on said release mechanism for contacting said detent tab and moving said inertia-actuated detent lever between said first unlocked position and said second unlocked position.

17. The improved latch assembly recited in claim 11 wherein said inertia-actuated detent lever has a notch integrally formed therein for receiving said detent tab when said inertia-actuated detent lever is located in at least one of said first unlocked position and said second unlocked position.

* * * * *